US006901618B2

(12) United States Patent
Oakhill et al.

(10) Patent No.: US 6,901,618 B2
(45) Date of Patent: Jun. 7, 2005

(54) LOW PROFILE MATTRESS

(75) Inventors: Timothy Oakhill, Atlanta, GA (US); Richard F. Gladney, Fairburn, GA (US); Don Hoffman, Atlanta, GA (US)

(73) Assignee: Dreamwell Ltd., Las Vegas, NV (US)

( * ) Notice: Subject to any disclaimer, the term of this patent is extended or adjusted under 35 U.S.C. 154(b) by 0 days.

(21) Appl. No.: 10/384,364

(22) Filed: Mar. 7, 2003

(65) Prior Publication Data

US 2004/0010854 A1 Jan. 22, 2004

Related U.S. Application Data

(60) Provisional application No. 60/363,029, filed on Mar. 7, 2002.

(51) Int. Cl.[7] ..... A47C 27/00
(52) U.S. Cl. ..... 5/699; 5/716
(58) Field of Search ..... 5/699–701, 716, 5/720, 721

(56) References Cited

U.S. PATENT DOCUMENTS 2,895,145 A * 7/1959 Oscar ..... 5/308
3,493,980 A * 2/1970 Haller ..... 5/716
3,581,322 A * 6/1971 Marsico ..... 5/699
5,311,624 A * 5/1994 Hutchinson ..... 5/699
5,950,264 A * 9/1999 Wyner et al. ..... 5/690
6,243,900 B1 * 6/2001 Gladney et al. ..... 5/720
2001/0008030 A1 7/2001 Gladney et al.
2003/0129904 A1 * 7/2003 Wolynes et al. ..... 442/211
2003/0229943 A1 * 12/2003 Lewis ..... 5/716

OTHER PUBLICATIONS

Document entitled "Amicor Pure–Scientifically proves allergen reduction from the fiber's core", publicatio date of Jan. 9, 2002.*

* cited by examiner

*Primary Examiner*—Michael Trettel
(74) *Attorney, Agent, or Firm*—Ropes & Gray, LLP

(57) ABSTRACT

A low-profile mattress comprises an inner spring core having a plurality of spring coils and having an upper and lower surface. The mattress further includes a padding layer disposed on the upper surface and a quilting layer disposed over the padding layer and having an exterior layer of a liquid resistant material, wherein the innerspring core padding layer and quilting layer are dimensionally adapted to be less than eight inches in height.

11 Claims, 2 Drawing Sheets

LOW PROFILE MATTRESS

CLAIM OF BENEFIT

This application claims the benefit of U.S. Provisional Application Ser. No. 60/363,029 filed 7 Mar. 2002, the contents of which are incorporated by reference herein.

FIELD OF THE INVENTION

The Systems and Methods described herein relate to mattresses, and more particularly, to mattresses suitable for use with children's bedding products.

BACKGROUND OF THE INVENTION

Studies have indicated that a good night's sleep is a fundamental part of a healthy lifestyle. This is true for adults as well as for children. A substantial amount of research has been done on the type of mattress products that adults require to achieve a good night's sleep. Similarly, an enormous amount of research has been done with regard to the types of bedding products that provide infants with a good and safe night's sleep. Due to this research there are today several excellent products on the market designed to position infants in a particular disposition, such as on their side, or on their back, for the purpose of reducing the likelihood if sudden infant death syndrome. Similarly, there are several products on the market today designed to give adults a better night's sleep, and thereby reduce the fatigue and related problems that can arise from a lack of sleep.

However, although a good night's sleep is as important to a child as it is to an adult or an infant, the vast majority of bedding products designed for children are designed merely to look appealing and provide no real sleep benefit. Truthfully, most children's mattresses today are inexpensive foam mattresses. If a parent wishes to purchase a quality mattress for a child, the parent typically is required to buy a mattress manufactured for an adult. Although there are many quality adult mattresses available, most of these mattresses do not fit well with children's bedding products.

For example, many children sleep in bunk beds. Bunk beds stack two beds, one on top of the other, in a manner that makes it difficult if not impossible to employ two adult size mattresses, each close to a foot in thickness, within the bunk bed space. Even the traditional children's bed is usually lower to the ground than an adult bed and less suited for use with a full-size adult mattress.

Most of the mattresses suited for children's bedding products comprise low quality foam core products. Although some of these foam core mattresses may be quite good at first, the typical foam core mattress does not hold up well to the rigorous use a child makes of their mattress. Accordingly, in a short period of time, depressions form within the sleeping surface and the ability of the mattress to provide a quality night's sleep deteriorates.

Thus, there is a need in the art for a child's mattress that provides a quality night's sleep and that is suited for use within children's bedding products.

SUMMARY OF THE INVENTION

The mattresses described herein include a low-profile mattress that comprises an inner spring core having a plurality of spring coils and having an upper and lower surface. The mattress further includes a padding layer disposed on the upper surface and a quilting layer disposed over the padding layer and having an exterior layer of a liquid resistant material, wherein the innerspring core padding layer and quilting layer are dimensionally adapted to be less than eight inches in height.

In particular embodiments, the low-profile mattress may include an innerspring core that includes a core of 500 coil count LSS unit. In other embodiments, the liquid resistant material may comprise a nano-pel fabric.

In still other embodiments, the lower layer may be formed of a substantial rigid material and disposed against the lower surface of the innerspring core.

In still a further embodiment, the low-profile mattress may comprise an allergy controlling agent that is disbursed within the padding layer.

In still a further embodiment, the mattress may include an interior compartment formed within the innerspring core and optionally having a moveable lid that may be placed over the opening of the compartment.

BRIEF DESCRIPTION OF THE DRAWINGS

The foregoing and other objects and advantages of the invention will be appreciated more fully from the following further description thereof, with reference to the accompanying drawings wherein.

DESCRIPTION OF THE ILLUSTRATED EMBODIMENTS

To provide an overall understanding of the invention, certain illustrative embodiments will now be described, including a low profile mattress having an inner-spring core and a liquid resistant covering. However, it will be understood by one of ordinary skill in the art that the mattress products described herein can be adapted and modified for other suitable applications and that such other additions and modifications will not depart from the scope hereof.

The systems and methods described herein include low-profile mattresses that provide a quality night's sleep and yet are suitable for use with conventional children's bedding products such as day beds, bunk beds, and other similar bedding products.

Figure 1:
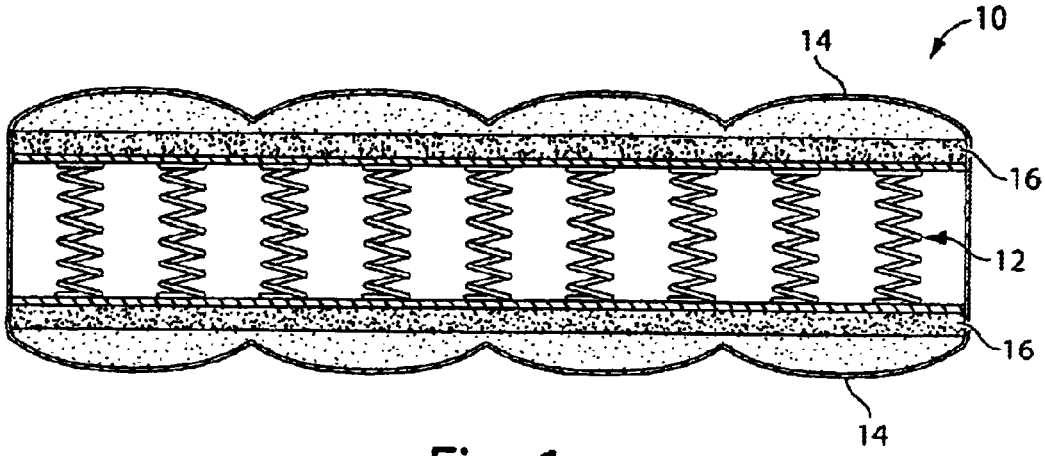
FIG. 1 depicts the first embodiment of the invention having an inner core spring, a padding layer, a quilting layer, and being dimensionally adapted for use with children's furniture.

FIG. 1 depicts the first embodiment of the low-profile mattresses described herein. Specifically, FIG. 1 depicts a mattress 10 that includes an inner core spring 12, a foam padding layer 16, and an upholstery layer 14. As shown in FIG. 1 the mattress 10 can have an upper and lower surface, and for the depicted embodiment the mattress is symmetrical in that both the upper and lower surface are each covered with a foam padding layer 16 and an upholstery layer 14. The inner core spring 12 (not shown in detail) generally comprises border wires forming a rectangular structure and, within the structure, a plurality of interconnected coil springs. The coil springs are generally disposed in rows and columns over the entire area of the rectangular structure. When designing an innerspring, a number of variables which affect innerspring performance must be taken into consideration. Some of these variables include the coil count, the coil density, the coil shape, the number of turns of the coil, the gauge of the wire, the heat treatment of the wire, the technique used to assemble the innerspring, and the edge treatment. The innerspring construction may be an open-coil construction or may also be a pocketed-coil type as identified in U.S. Pat. No. 4,234,933 to Stumpf, which is incorporated herein by reference. In optional embodiments, the mattress 10 may be a one-sided mattress that includes a substantially rigid layer on one side of the mattress. Additionally, in some embodiments, the mattress 10 includes a fire retardant fabric that acts as a barrier to prevent or slow the progress of a flame exposed to the exterior the mattress 10 from igniting the mattress padding, or the inner core spring 12. For example, a fire barrier fabric can be incorporated in the quilt panel structure during the quilting operation and interposed between the layer of fiber or filler material and the ticking. The fire barrier fabric may also be attached to one of the layers, for example, the cover, with an adhesive. The fire barrier fabric when used as the backing material, can significantly reduce the fire hazard due to the material properties of the fire barrier fabric that will hinder the propagation of a fire to the entire mattress body. For added fire protection, the fire barrier fabric can also be placed directly under the border ticking layer. The fire blocking layer may comprise any suitable material and in one embodiment consists of Firegard® LWB, sold by Chiquola Industrial Products, LLC, Honea Path, S.C., U.S.A., and extends over the mattress panels and the borders.

As further shown in FIG. 1, the depicted mattress 10 includes an inner core spring 12 that comprises a plurality of spring elements. In the depicted embodiment, the inner core spring elements are contained within a fabric covering as is customary with the Marshall pocketed coil spring technique. The depicted embodiment discloses a pocket coil inner core spring while in other embodiments the inner core may comprise an open wire spring mattress. The size of the wire springs may vary according to the overall structure of the mattress 10, but in any case, the size of the spring should be selected to provide a mattress height that is appropriate for the application. Height ranges can be less than 12 inches and more typically, between 9 and 6 inches. To this end, the spring size may be selected to be approximately 4.5 to 5 inches in length. However, in other embodiments, the spring size may range from 2 inches to 7 inches.

For the mattress 10 depicted in FIG. 1, the inner core spring 12 comprises a plurality of wire springs each of which is dimensionally adapted to provide a low profile mattress. To this end, the inner core spring 12, the two foam padding layers 16 and the two upholstery layers 14 may, in total, have a height of eight inches or less. In one embodiment, the inner core spring 12 comprises a plurality of wire springs of reduced height. For example, the wire springs may have a height of approximately 5 inches or less. As a consequence, the profile for the mattress 10 is lower than the profile of a conventional mattress having an inner core spring and padding on either side.

Figure 2:
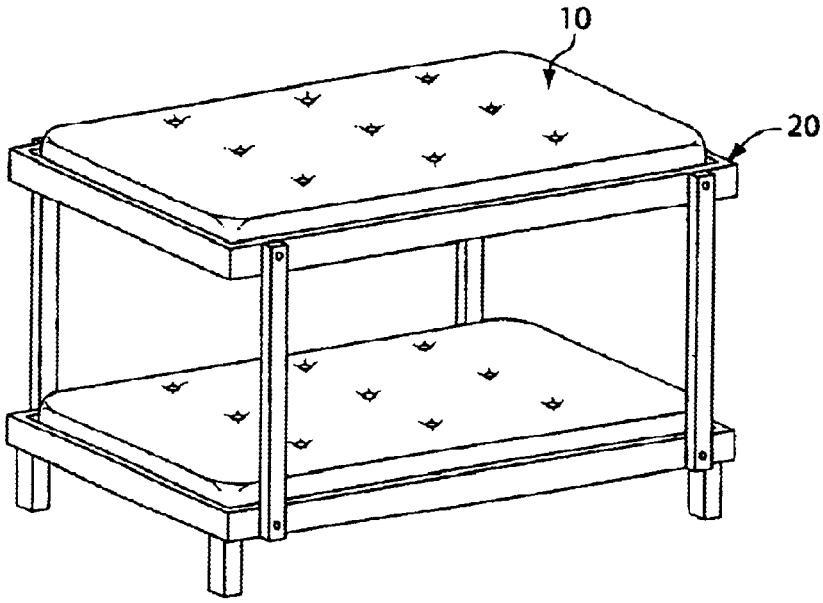
FIG. 2 depicts the mattress of FIG. 1 shown within a bunk bed child bedding product.

Shown in FIG. 2 is a bunk bed 20 that provides a support frame for the mattress 10 of FIG. 1. As shown in FIG. 2, the mattress 10 fits within the bunk bed frame 20 providing clearance for the user resting on the lower bunk and beneath the upper bunk. Thus, the mattress 10 is versatile for a variety of children's sleeping situations including bunk beds, regular bed frames, day beds, trundle beds, and other common children bedding products. In certain embodiments, the mattress 10 may be used with a foundation or box spring. In other embodiments the mattress may be employed with a bunkie board to fit bunk and trundle beds. A bunkie board is a rigid board that fits within a bed frame and under the mattress to give support to a mattress within the frame. The bunkie board can a wooden board, plastic, or rigid foam board that optionally is covered in fabric, and may be upholstered. In FIG. 2, the bunkie board could fit under the depicted mattresses and into the frame of the bunk bed 20. Such a design further reduces the height that the mattress extends out of the frame, and makes the bed more difficult for the child to mount.

In an optional embodiment, the low-profile mattress 10 depicted in FIG. 1 may include a padding layer formed of an allergy resistant fiber. In one embodiment, the depicted padding layers 16 use the ALLERFREE™ fiber product that is understood to be effective in eliminating indoor allergens from the home. It is further understood that these indoor allergens are a leading cause of asthma for children. The ALLERFREE™ fiber may comprise the AMICOR™ smart fiber of the kind manufactured and sold by the Acordis Company of Westervoortsedijk, The Netherlands. AMICOR™ is a smart fiber with a locked in safe and durable additive that can act against allergens (a known cause of asthma) and bacteria (a cause of odor). There are three types of commercially available products, all of which are suitable, although the product employed may depend upon the application: an anti-bacterial fiber with locked in freshness; a dual activity anti-bacterial and anti-fungal fiber; and a blend of anti-bacterial and anti-fungal fibers that can prevent house dust mites and microbes in bedding and household textiles. The preferred material of AMICOR™ provides an anti-microbial strength that is more than a fragile, surface treatment, as described in *Roland Cox*, The Benefits of Antimicrobial Additives in Fibres. Amicor (pure) The Science Behind it. The organic additive is built into the fiber, not just added to the surface, so AMICOR™ fibers do not easily lose their efficacy. Studies have shown that after 200 washes the fibers are still effective. It has a built-in organic, chemical additive Triclosan, which has proven to be effective against bacteria and safely used in mouthwashes and toothpastes for many years. AMICOR™ Pure was developed to prevent the problem of the common dust mite that causes 70% of asthma in the home. Used in bedding, it effectively removes the fungi and bacteria that the dust mite feeds on and is the gentlest and most thorough approach to preventing the problem at source. AMICOR™ Pure operates by blocking the growth of the fungi that turns human skin into a food source for the mites, so that the mites are completely unable to thrive in bedding. This safe, preventative method is the recognized route forward in anti-allergenic preparations.

In a further embodiment, it will be understood that the quilting layer 14 may include an exterior layer of fabric that is liquid resistant. As the low-profile mattress 10 is designed for use with children, bedwetting, spills and other situations commonly arise where it is beneficial to have a liquid resistant, or liquid impervious, exterior to the mattress. To this end, the mattress 10 depicted in FIG. 1 includes an exterior surface that is formed of a liquid resistant material such as the nano-pel fabric that resists the flow of fluid through the fabric to the foam layer under the quilting sheet. The material used can include, in one embodiment, the nano-pel fabric manufactured by Nano-Tex, LLC, operating as a subsidiary of Burlington. This fabric is made with a technology creating superior repellency that allows water and oil spills to easily bead and roll off of fabric without penetrating the fibers. This technology works at the molecular level to graft an outer layer of cotton-like properties around a synthetic fiber core and preserves the fabric's original hand and breathability while maintaining durable performance throughout the life of the fabric. Other products include NANO-CARE (enhances cotton fabrics with water and oil repellent and wrinkle resistant properties) and NANO-DRY (enhances synthetic fabrics with advanced moisture control properties that provide quicker drying and better comfort).

As shown in FIG. 1, the exterior liquid resistant layer may be a thin layer of material that actually forms the exterior of the mattress 10. As further shown by FIG. 1 the liquid resistant material is quiltable, thereby providing the quilted exterior surface for the mattress 10, and thus avoiding the need for a separate mattress pad to provide liquid resistant characteristics.

Figure 3:
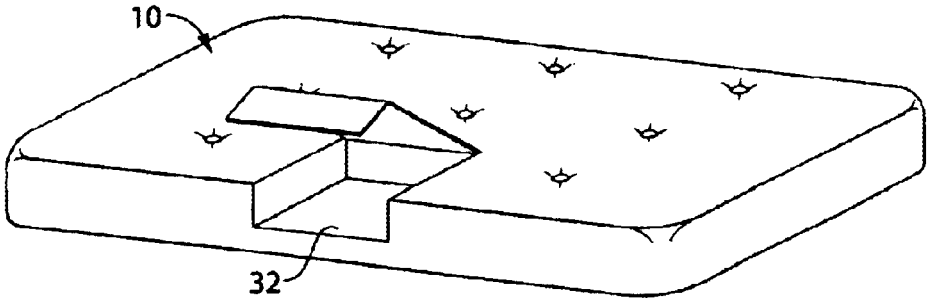
FIG. 3 depicts an alternative embodiment of the invention having a compartment formed within the inner core spring.

Turning now to FIG. 3, a further embodiment is depicted wherein a compartment is formed within the mattress. As depicted, the compartment is dimensionally adapted to provide storage space for household items, typically being children's play things, books and other similarly sized objects. In an optional embodiment, the compartment may be formed as a pocket on the side of the bed. In this embodiment the pocket may be formed as part of the upholstery covering.

Figure 4:
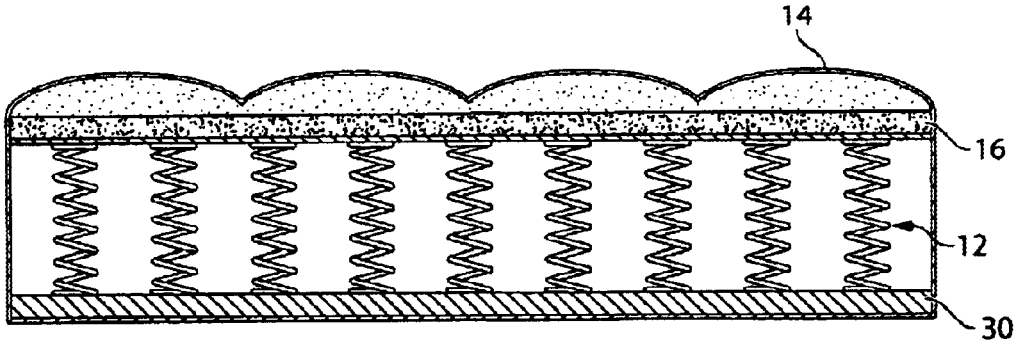
FIG. 4 depicts a further alternative embodiment of the invention having a rigid layer formed under and contacting the lower surface of the inner core spring.

FIG. 4 depicts a further alternative embodiment of the invention. In FIG. 4 a lower rigid layer 30 is disposed against and in contact with the lower surface of the inner core spring 12. As described in U.S. Pat. No. 6,408,469 issued to Gladney et al. and owned by Assignee hereof, the lower rigid layer may reduce or prevent the formation of deformations in the upper sleeping surface of the mattress. Accordingly, the embodiment in FIG. 4 may provide for a more robust mattress more capable of withstanding the rigorous use a child can put to their bedding.

In further embodiments, the mattress 10 described above is provided with a pillow that also is treated to address allergies and has self-replenishing fibers that offer a gentle and effective approach to the reduction of indoor allergens for those who are already indoor-allergy sensitive. These self-replenishing fibers help to reduce indoor allergens that can trigger allergic reactions and asthma—helping you rest easier and breathe more freely.

Those skilled in the art will know or be able to ascertain using no more than routine experimentation, many equivalents to the embodiments and practices described herein. Moreover, it will be understood that the low profile mattresses described herein are sized for meeting the dimensional demands of children bedding products. This includes providing mattress that have a sufficiently low profile that the sleeping surface of the mattress will not extend beyond or up to the railing height of a bunk bed. In an other example, the mattress profile will be sufficiently low to allow the mattress to be used as part of a trundle bed that slides within a compartment built into the bed frame, or in some other manner. Other applications can include use with day beds, that are used as sofas/love seats during the day and as beds at night. Accordingly, it will be understood that the invention is not to be limited to the embodiments disclosed herein, but is to be understood from the following claims, which are to be interpreted as broadly as allowed under the law.

What is claimed is:

1. A low profile mattress, comprising an innerspring core having a plurality of spring coils, and having an upper and a lower surface, a padding layer disposed on the upper surface and comprising an allergy controlling agent dispensed within the padding layer, and a quilting layer disposed over the padding layer and comprising a quilted layer of a breathable liquid resistant material, where said inner spring core, padding layer and quilting layer are dimensionally adapted to be less than eight inches in height.

2. A low profile mattress according to claim 1, wherein the breathable liquid resistant material comprises nano-pel fabric.

3. A low profile mattress according to claim 1, further comprising a lower layer formed of a substantially rigid material and disposed against the lower surface of the innerspring core.

4. A low profile mattress according to claim 1, further comprising an interior compartment formed within the inner core spring.

5. A low profile mattress according to claim 4, further comprising a moveable lid formed over the interior compartment.

6. A low profile mattress according to claim 1, further including a bunkie board for supporting the mattress within a bed frame.

7. A low profile mattress according to claim 1, further including a fire retardant material positioned as a fire barrier between an exterior surface of the mattress and the padding layer.

8. A method for manufacturing a low profile mattress, comprising the steps of providing an innerspring core having a plurality of spring coils, and having an upper and a lower surface disposing a padding layer on the upper surface, said padding layer comprising an allergy controlling agent dispensed within the padding layer, and disposing a quilting layer over the padding layer, said quilting layer having an exterior layer of breathable liquid resistant material, where said inner spring core, padding and layer quilting layer are dimensionally adapted to be less than eight inches in height.

9. A method according to claim 8, comprising the step of providing a lower layer formed of a substantially rigid material and disposed against the lower surface of the innerspring core.

10. A method according to claim 8, comprising the step of providing an interior compartment formed within the inner core spring.

11. A method according to claim 8, comprising the step of providing a bunkie board for supporting the mattress within a bed frame.

* * * * *